US008696367B2

(12) United States Patent
Daughtry, Jr. et al.

(10) Patent No.: US 8,696,367 B2
(45) Date of Patent: Apr. 15, 2014

(54) TWO-PIECE CONNECTOR ASSEMBLY FOR CONNECTING AN ELECTRONIC DEVICE TO A CIRCUIT BOARD

(71) Applicant: Genesis Technology USA, Inc., Norcross, GA (US)

(72) Inventors: Earl Anthony Daughtry, Jr., Lawrenceville, GA (US); Yi Fei Luo, Shaoyang (CN); Chi-Lun Lin, Taipei (TW)

(73) Assignee: Genesis Technology USA, Inc., Norcross, GA (US)

( * ) Notice: Subject to any disclaimer, the term of this patent is extended or adjusted under 35 U.S.C. 154(b) by 0 days.

(21) Appl. No.: 13/943,262

(22) Filed: Jul. 16, 2013

(65) Prior Publication Data

US 2013/0303004 A1 Nov. 14, 2013

Related U.S. Application Data

(63) Continuation of application No. 13/298,719, filed on Nov. 17, 2011, now abandoned.

(60) Provisional application No. 61/434,680, filed on Jan. 20, 2011.

(51) Int. Cl.
*H01R 12/00* (2006.01)

(52) U.S. Cl.
USPC ..... 439/83

(58) Field of Classification Search
USPC ..... 439/342, 327, 814, 248, 52, 78
See application file for complete search history.

(56) References Cited

U.S. PATENT DOCUMENTS

| | | | | |
|---|---|---|---|---|
| 4,641,426 | A | 2/1987 | Hartman et al. | |
| 4,663,815 | A | 5/1987 | Hartman et al. | |
| 4,755,149 | A | 7/1988 | De Jong et al. | |
| 4,992,056 | A * | 2/1991 | Douty et al. | 439/83 |
| 4,998,887 | A | 3/1991 | Kaufman et al. | |
| 6,159,023 | A * | 12/2000 | Lai | 439/79 |

(Continued)

FOREIGN PATENT DOCUMENTS

WO WO 2012/099644 7/2012

OTHER PUBLICATIONS

U.S. Official Action dated Nov. 9, 2012 in U.S. Appl. No. 13/298,719, filed Nov. 17, 2011, First Named Inventor: Daughtry, Jr.

(Continued)

*Primary Examiner* — Chandrika Prasad
(74) *Attorney, Agent, or Firm* — Hope Baldauff, LLC

(57) ABSTRACT

This disclosure is directed to apparatuses, systems, and methods associated with a connector assembly for use with surface mount technology (SMT). The connector assembly has a connector header configured to be mounted to a circuit board and is constructed of a high-temperature resistant material suitable for use with a reflow soldering process. The connector header includes at least one connector socket and at least one mounting shoulder, and is configured to be coupled to a header attachment assembly. The header attachment assembly comprises at least one connector pin and at least one mounting shoulder, and is configured to be coupled to the connector header. An electronic device, such as a card reader or hard drive, may be connected to the header attachment assembly and thereby to the circuit board. The connector assembly allows for the obstructed view inserting and attaching in a manual or an automated assembly process.

13 Claims, 8 Drawing Sheets

(56) References Cited

U.S. PATENT DOCUMENTS

| | | | | |
|---|---|---|---|---|
| 6,280,264 | B1 | 8/2001 | Whipple et al. | |
| 6,743,037 | B2 | 6/2004 | Kassa et al. | |
| 6,837,730 | B2 | 1/2005 | Poh et al. | |
| 6,862,190 | B2 | 3/2005 | Olzak et al. | |
| 7,179,094 | B2 | 2/2007 | Kawahara et al. | |
| 7,520,751 | B2 | 4/2009 | Kim | |
| 7,553,163 | B2 | 6/2009 | McAlonis et al. | |
| 7,931,503 | B2 * | 4/2011 | Zhuang | 439/676 |
| 7,976,319 | B2 | 7/2011 | Nguyen et al. | |
| 2003/0211759 | A1 | 11/2003 | Olzak et al. | |
| 2008/0194130 | A1 | 8/2008 | Kimura | |

OTHER PUBLICATIONS

U.S. Official Action dated Feb. 22, 2013 in U.S. Appl. No. 13/298,719, filed Nov. 17, 2011, First Named Inventor: Daughtry, Jr.

International Search Report dated Mar. 27, 2012 in PCT/US2011/063120.

* cited by examiner

TWO-PIECE CONNECTOR ASSEMBLY FOR CONNECTING AN ELECTRONIC DEVICE TO A CIRCUIT BOARD

CROSS-REFERENCE TO RELATED APPLICATION

This application is a continuation of U.S. patent application Ser. No. 13/298,719, filed Nov. 17, 2011, which application claims the benefit of U.S. Provisional Patent Application No. 61/434,680, filed Jan. 20, 2011, both of which are expressly incorporated herein by reference in their entirety.

BACKGROUND

Surface mount technology (SMT) is a method of constructing electronic circuits by mounting and soldering electronic components to the surface of a circuit board without, usually, the use of through-hole technology. Surface mounting lends itself to automation, which reduces labor costs and increases production rates. Surface mounting also lends itself to mounting and soldering electronic components to both sides of a circuit board.

With regard to a typical automated SMT process, components to be soldered to a circuit board may be delivered to a production line on trays or wound on reels or tubes. Computer controlled pick-and-place machines take the components and place them on the circuit board. The circuit board and components are then soldered with a reflow process. There are several reflow soldering processes currently in use including infrared reflow, vapor phase reflow, wave soldering, and convection heat.

It is with respect to these considerations and others that the disclosure made herein is presented.

SUMMARY

A connector assembly comprising a connector header and a header attachment assembly is disclosed herein. The connector assembly embodiments disclosed herein are suitable for use with reflow soldering processes. According to one aspect the connector header, constructed of a material that can withstand the reflow soldering process, is mounted to the surface of a circuit board and soldered with a reflow process. The header attachment assembly, constructed of a material that may not be able to withstand the reflow soldering process, is later coupled to the connector header. The header attachment assembly may comprise an electronic device, such as but not limited to a card reader, or be connected to an electronic device, such as but not limited to a hard drive.

According to one aspect, a connector header configured to be attached to a mounting surface includes at least one connector socket configured to receive a connector pin, and at least one mounting sleeve configured to matingly engage a mounting shoulder. A header attachment assembly configured to be attached to the connector header comprises at least one connector pin configured to be connected to the connector socket, and at least one mounting shoulder configured to matingly engage the mounting sleeve.

According to an embodiment described herein, the connector header further comprises at least one receiving channel configured to guide a connector pin toward its respective connector socket. In another aspect, the connector socket includes a solder terminal configured to be soldered to the circuit board. In still another aspect, the connector header includes a solder nail configured to be soldered to the circuit board.

According to an alternative embodiment, the header attachment assembly further comprises at least one electronic contact communicatively connected to a connector pin. In another aspect, the header attachment assembly includes a mounting shoulder rib. In still another aspect, the header attachment assembly includes a mounting post for attachment to the circuit board.

Methods of utilizing a two-piece connector assembly are taught herein. A method teaches obtaining a circuit board, a connector header, and a header attachment assembly. The connector header is manufactured from a first material suitable for use with a surface mount device reflow soldering operation. The header attachment assembly is manufactured from a second material that may not be suitable for a reflow soldering operation. Another aspect of the method includes attaching the connector header to the circuit board and performing a reflow soldering operation to couple the connector header to the circuit board. In still another aspect, the header attachment assembly is coupled to the connector header after the reflow soldering operation.

Alternative embodiments of the methods include obtaining a connector header that comprises a mounting sleeve and obtaining a header attachment assembly that comprises a mounting shoulder. Another embodiment includes obtaining a header attachment assembly that comprises a mounting shoulder rib. Still other embodiments include the obstructed view engaging of the connector header and header attachment assembly. Additional embodiments include electronically connecting an electronic device to the header attachment assembly such that the connector assembly connects the electronic device to the circuit board.

It should be appreciated that the above-described subject matter may also be implemented as an electrical apparatus, a manufacturing process, an electrical and mechanical system, or as an article of manufacture. The features, functions, and advantages that have been discussed can be achieved independently in various embodiments of the present disclosure or may be combined in yet other embodiments, further details of which can be seen with reference to the following Detailed Description and Drawings.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
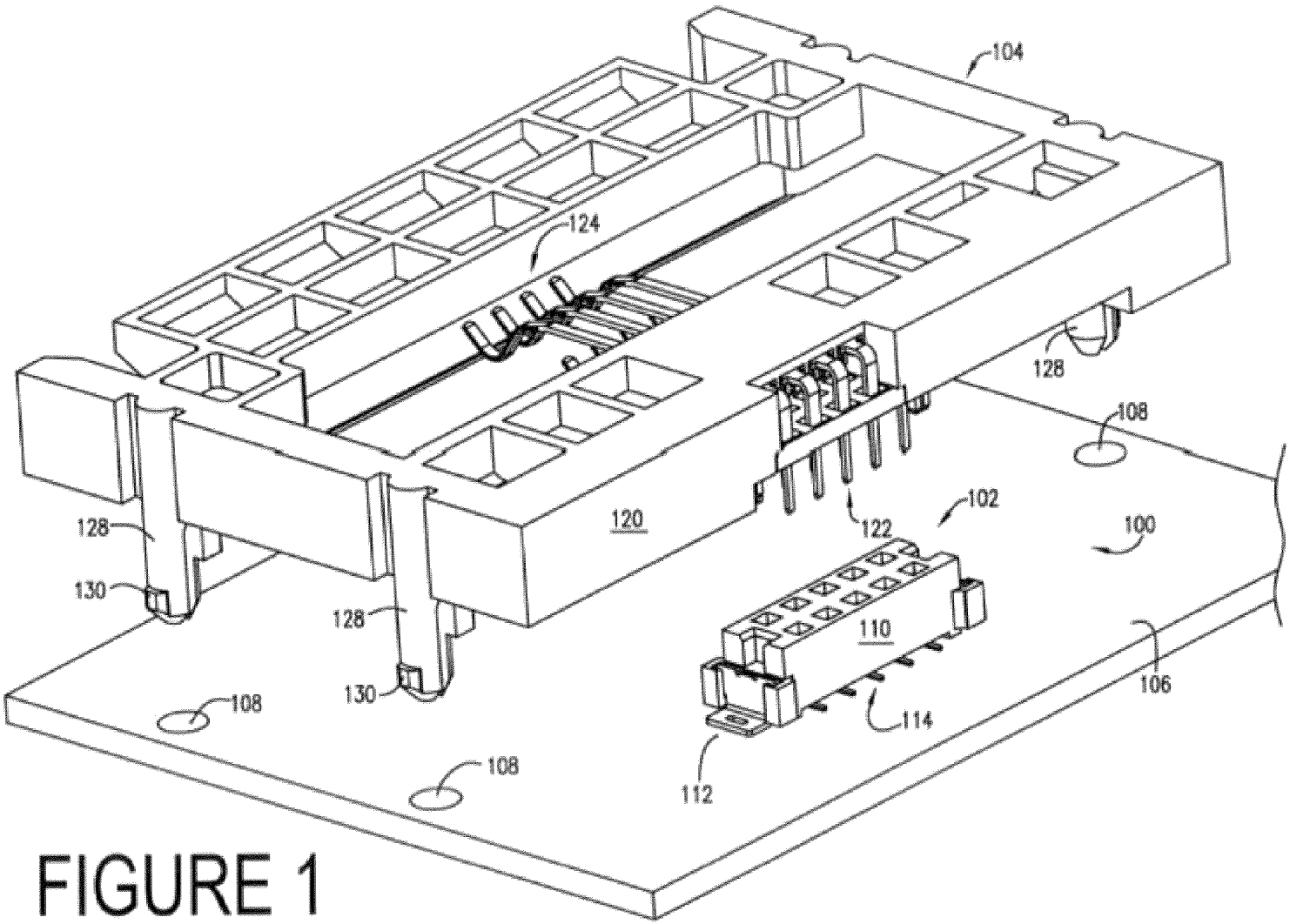
FIG. 1 is a top-view perspective diagram showing an exemplary connector assembly.

The following Detailed Description is directed to apparatuses, systems, and methods for utilizing a connector header for coupling a header attachment assembly to a circuit board. The embodiments taught herein are applicable to both the automated assembly and interconnecting of electrical components to circuit boards using surface mount technology (SMT), as well as the manual assembly and interconnecting of electrical components to circuit boards using other soldering process. With regard to SMT assembly, utilizing the connector assembly embodiments provided herein a connector header is included with other electrical components during the SMT assembly and reflow soldering of the circuit board. A header attachment assembly—a circuit board component which may not be compatible with reflow soldering, or which may be advantageously added later in the assembly process—is then coupled to the connector header to electrically and mechanically connect to the circuit board.

In the following Detailed Description, references are made to the accompanying drawings that form a part hereof, and which are shown by way of illustrated embodiments and example. The drawings are not drawn to scale. Accordingly, the dimensions or proportions of particular elements, or the relationships between different elements, as shown in the drawings are chosen only for convenience of description and do not limit possible implementation of this disclosure. Referring now to the drawings, in which like numerals represent like elements through the several figures, aspects of apparatus, system, and methodology for a connector assembly will be described.

Figure 2:
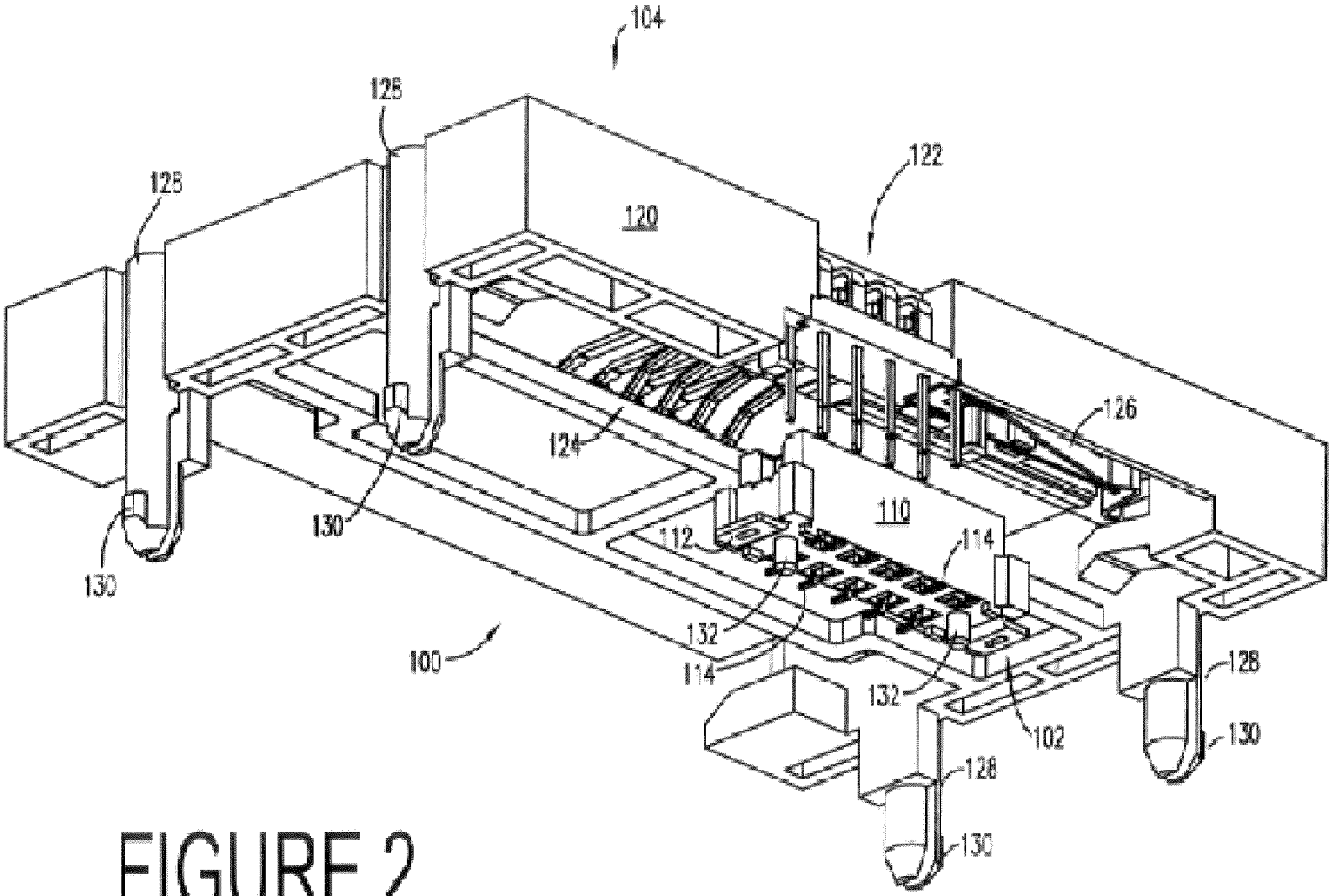
FIG. 2 is a bottom-view perspective diagram showing the exemplary connector assembly of FIG. 1.

FIGS. 1 and 2 are perspective diagrams showing various aspects of an exemplary connector assembly 100 as disclosed herein. As shown in FIGS. 1 and 2, the illustrated connector assembly 100 includes a connector header 102 and a header attachment assembly 104. Both the connector header 102 and header attachment assembly 104 will be coupled to a circuit board 106, which includes mounting apertures 108, as described herein. As used herein, the term "coupled" includes one element, component, device, and the like being electrically connected and mechanically connected to another element, component, device, and the like.

The connector assembly 100 as taught herein may be used with any element, component, device, and the like to be connected to a circuit board. Further, the connector assembly 100 as taught herein may be used with any process of assembly and interconnecting of electrical components to a circuit board, including SMT and reflow soldering. Accordingly, for the purpose of teaching, describing, and illustration, and not restriction or limitation, the present disclosure is presented within the context of different embodiments, including a card reader communicatively connected to any type of electronic device that might receive and obtain data from a card, such as but not limited to an ATM, a vending machine, a point of sale device, and the like. It should then be appreciated that the header attachment assembly 104 illustrated here is shown in the form of a card reader body configured for receiving and electronically linking a substantially planar card comprising circuitry or embedded electronics from which data may be retrieved, such as a smart card, chip card, ICC card, and the like.

The illustrated connector header body 110 is fabricated from a high-temperature thermoplastic, such as liquid crystal polymer (LCP), or polyamide nylon (PA9T), and the like, suitable for withstanding reflow solder temperature profiles. In other embodiments other high-temperature resistant materials or composites may be used to fabricate the connector header body 110. The connector header body 110 may include elements that are molded or attached, including solder nails 112 for mechanically connecting and solder terminals 114 for electrically connecting the connector header 102 to the circuit board 106, as described below. As used herein the term "solder nail", whether in the singular or plural, includes an oversized SMT solder terminal that provides increased surface area and mechanical strength for connecting components to the circuit board 106.

The illustrated header attachment assembly body 120 is fabricated from a less expensive thermoplastic, such as medium-density polyethylene (MDPE), or polybutylene terephthalate (PBT), combinations thereof, and the like. In other embodiments other materials or composites may be used to fabricate the header attachment assembly body 120. The header attachment assembly body 120 may include elements that are molded or attached, including connector pins 122 for coupling to the connector header 102, conductive electronic contacts 124 for electronically linking the circuitry of a smart card to the card reader, and switch contacts 126 for detecting the full insertion of a card into the header attachment assembly 104.

According to one embodiment, the header attachment assembly body 120 includes a plurality of engaging members, shown here as mounting posts 128 molded with the header attachment assembly body 120. The mounting posts 128 are configured for insertion into correspondingly located mounting apertures 108 in a mounting surface, such as the illustrated circuit board 106, a platform, a chassis, a case, and the like. The mounting posts 128 may be solid or split, and may include a tab or boss 130 or other mechanisms for securing the header attachment assembly 104 to the circuit board 106. Other types of mechanical and/or chemical engaging mechanisms, such as but not limited to solder nails, arms, extensions, bridges, bolts, welds, combinations thereof, and the like might be utilized to attach the header attachment assembly 104 to the circuit board 106. Also, as best shown in FIG. 2, the connector header body 110 may include a locator post 132 for positioning and obstructed view inserting of the connector header 102 to the circuit board 106.

Figure 3:
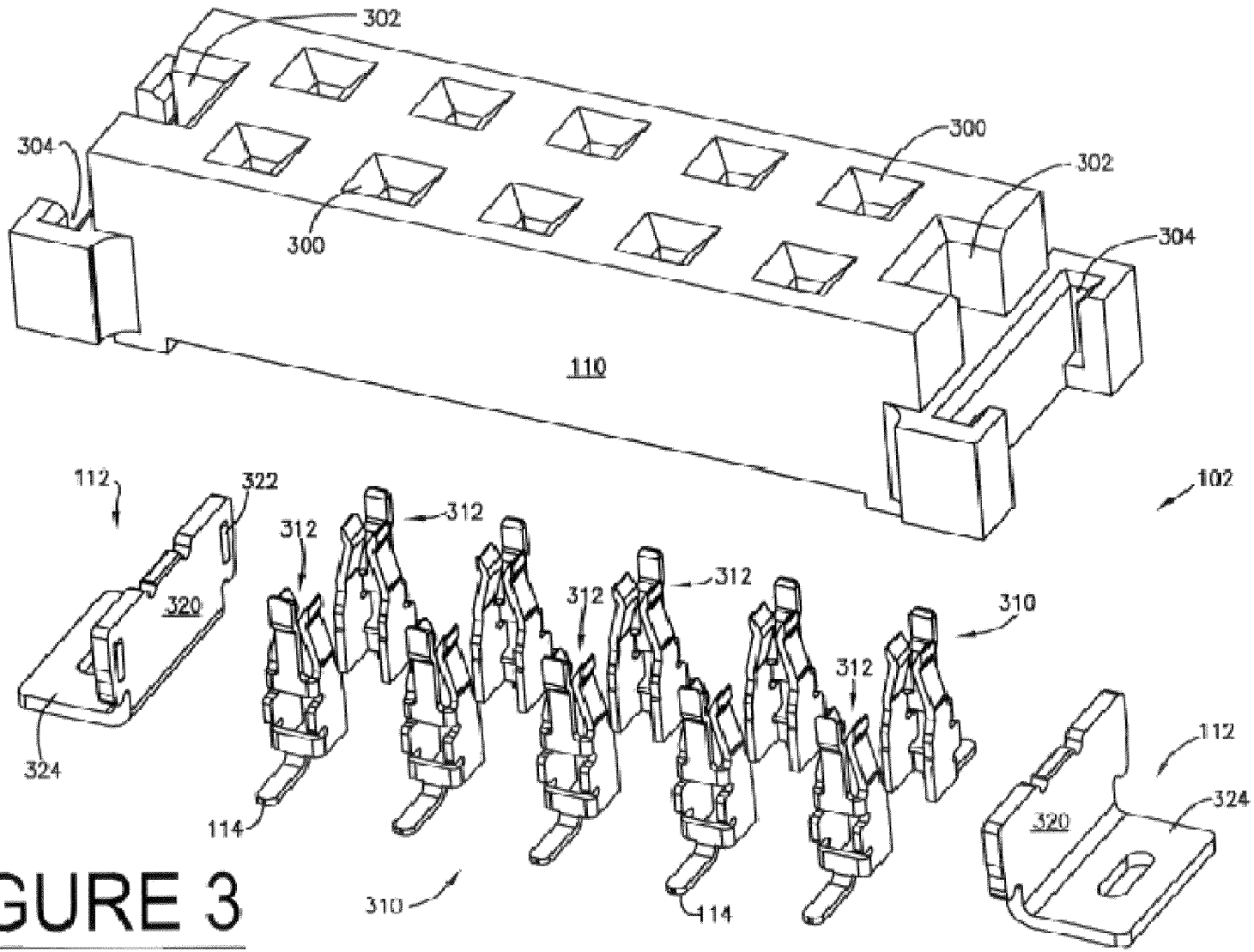
FIG. 3 is an exploded perspective diagram illustrating an exemplary connector header.

Turning now to FIG. 3, this is shown an exploded perspective diagram illustrating the exemplary connector header 102 of FIGS. 1 and 2. The illustrated connector header body 110 comprises a plurality of receiving channels 300, mounting sleeves 302, and engaging tab channels 304. Each edge of the open end of the illustrated receiving channels 300, mounting sleeves 302, and engaging tab channels 304 are shown tapered. An advantage of these components having at least one edge of the open end tapered is appreciated during obstructed view attachment or assembly. In some alternative embodiments, however, not every edge of an open end is tapered. Obstructed view attachment or assembly of these components can be easier and more reliable with at least one edge of an open end tapered. In some alternative embodiments some or all of these components do not have tapered ends. In some alternative embodiments the attachment or assembly of some or all of these components is not obstructed view.

Positioned within each receiving channel 300 is a respective connector socket 310 comprising a plurality of resilient spring fingers 312. The resilient spring fingers 312 are configured to frictionally receive and connect to a connector pin 122 when the header attachment assembly 104 is coupled to the connector header 102 as further described herein.

An advantage of the present disclosure is that the flat configuration of the connector pin(s) 122 and the flat configuration of the resilient spring fingers 312 offers improved connectivity between the connector header 102 and header attachment assembly 104. Some connector socket 310 embodiments comprise a greater number of resilient spring fingers 312 and some embodiments comprise a fewer number. Each illustrated connector socket 310 further includes a solder terminal 114, which is connected to the circuit board 106 during the soldering operation of assembly.

The illustrated connector header body 110 comprises two integral mounting sleeves 302. Each mounting sleeve 302 is configured to receive a mounting shoulder 400, best shown in FIG. 4, when the header attachment assembly 104 is coupled to the connector header 102, as further described herein. Alternative embodiments of the connector header body 110 may include more than two mounting sleeves 302, or just one. In addition, mounting sleeves 302 may be integral to the connector header body 110. As used herein the term "integral" includes an element described herein that may be molded into or attached to another element. By way of example and not limitation, the mounting sleeve 302 may be molded with or attached to the connector header body 110. The mounting shoulders 400 of the exemplary embodiments include a mounting shoulder rib 402. An advantage of the present disclosure is that the combination of the illustrated mounting sleeves 302 and mounting shoulders 400 provides for obstructed view insertion and attachment of the header attachment assembly 104 to the connector header 102. Further, the combination of mounting sleeves 302 and mounting shoulders 400 provides a structure that prevents damage to the connector pins 122 during attachment of the header attachment assembly 104 to the connector header 102.

The illustrated connector header body 110 also comprises two engaging tab channels 304. The engaging tab channels 304 are configured to receivingly connect an engaging tab 320 of a solder nail 112. The illustrated engaging tabs 320 include an engaging tab rib 322. The solder nails 112 include a securing tab 324.

In practice, the connector header 102 may be assembled by positioning and aligning each connector socket 310 within the connector header body 110 and with respect to a respective receiving channel 300, such that when coupling the header attachment assembly 104 to the connector header 102 as shown herein, a connector pin 122 may be inserted into a respective receiving channel 300 and connector socket 310. The engaging tabs 320 may be inserted within the engaging tab channels 304. The connector header 102 may now be attached to a mounting surface, such as the circuit board 106, as best shown in FIG. 1.

Figure 4:
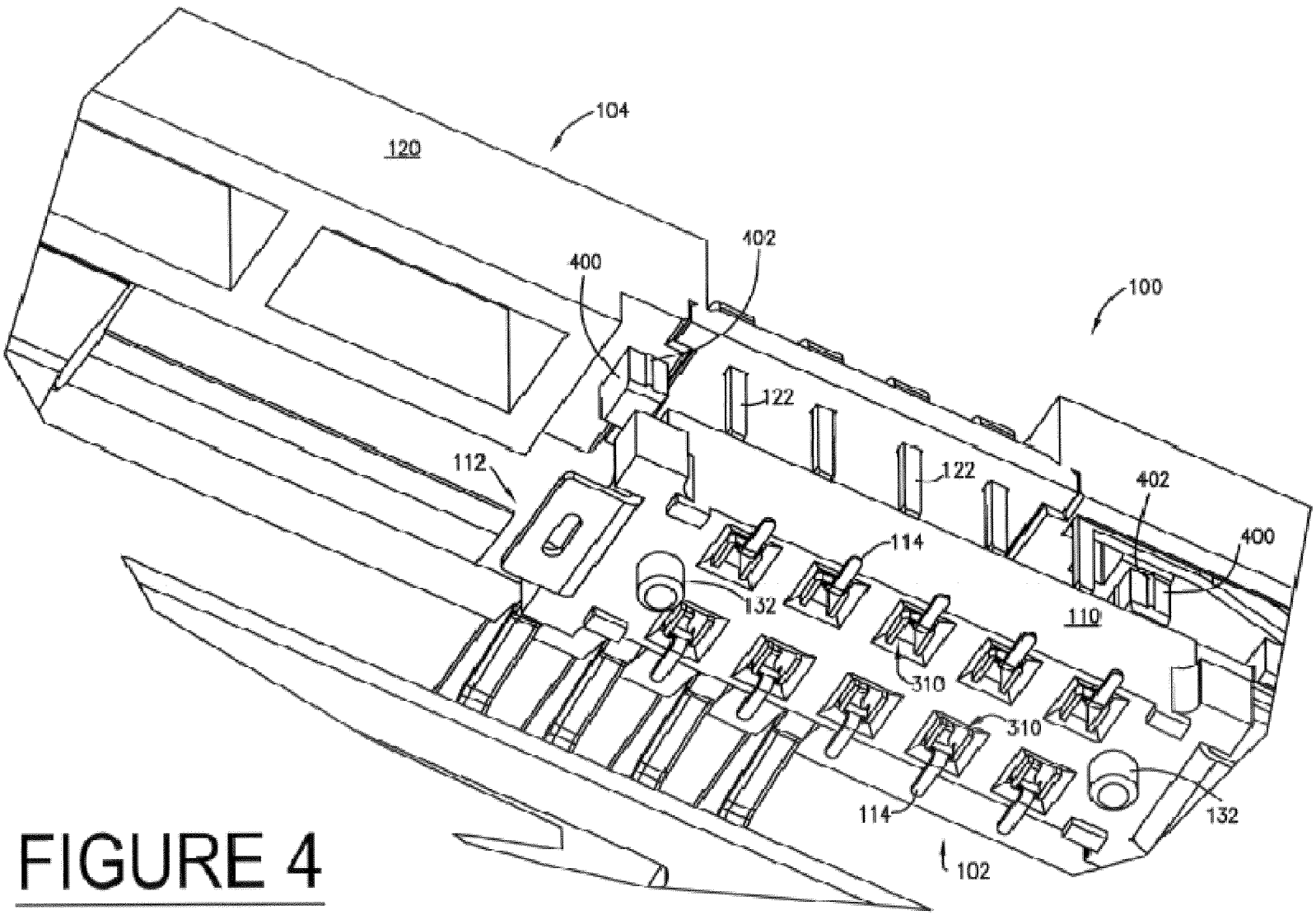
FIG. 4 is a partial bottom-view perspective diagram showing the mounting of an exemplary header attachment assembly to an exemplary connector header.

With reference to FIGS. 1, 2 and 4, a method of constructing the connector assembly 100 will now be described. The connector header 102, which may include locator posts 132 configured to be inserted into mounting apertures 108, is positioned on the circuit board 106. Other electrical components may be attached to the circuit board 106 and then, together with the connector header 102, connected to the circuit board 106 during a soldering operation such as used with surface mount technology (also sometimes referred to as surface mount device) reflow soldering. During the soldering operation a solder fillet may be placed along the exterior edges of the solder terminal(s) 114 and solder nail 112 securing tab(s) 324. In this way the connector header 102 is coupled to the circuit board 106.

Figure 5:
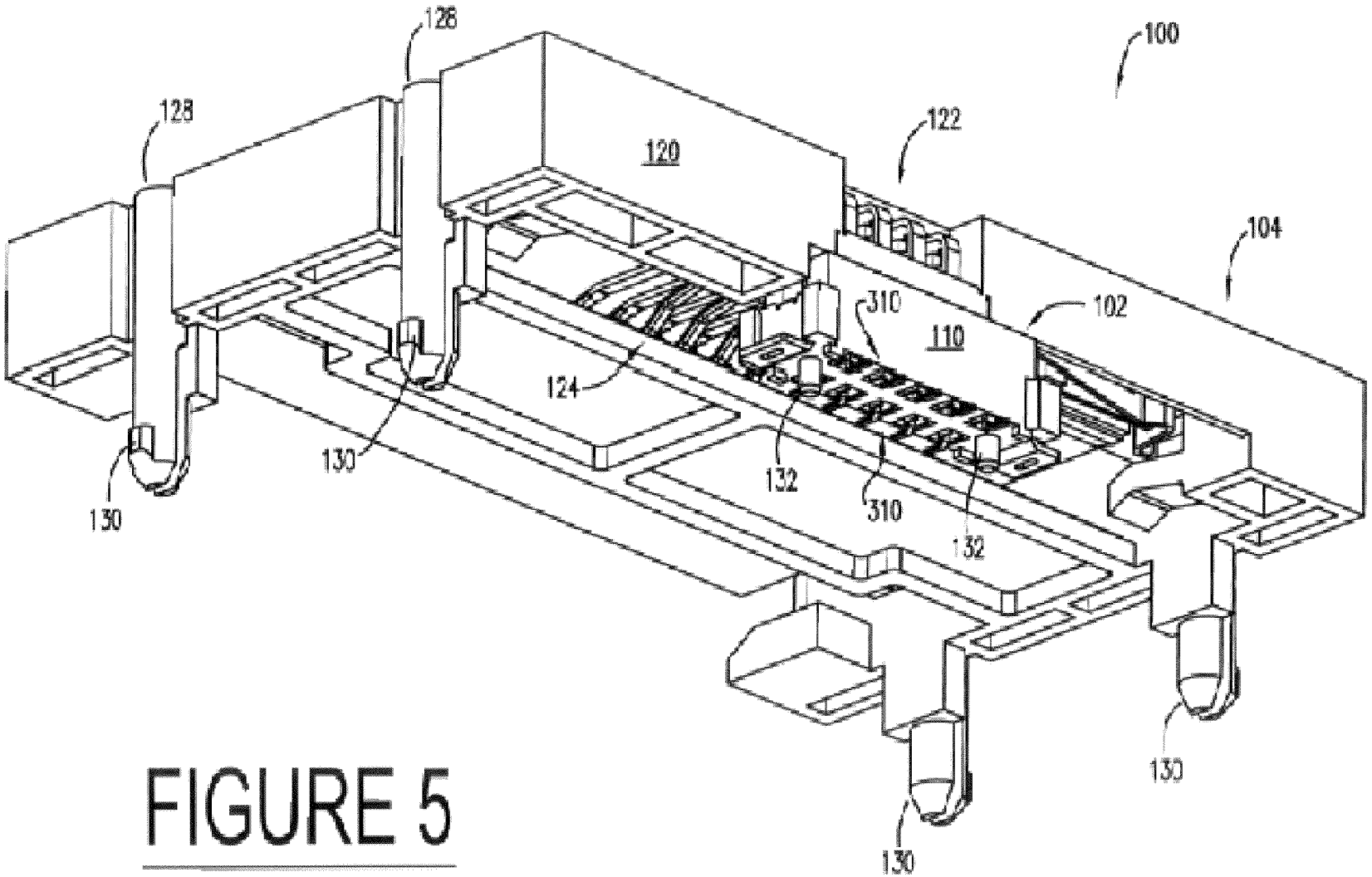
FIG. 5 is a perspective diagram illustrating an exemplary header attachment assembly mounted to a connector header.

After the soldering operation the header attachment assembly 104 may be connected to the circuit board 106 by, substantially simultaneously, aligning and inserting the mounting posts 128 into the mounting apertures 108, the mounting shoulder 400 into the mounting sleeve 302, and the connector pins 122 into the connector sockets 310. In this way, as perhaps best shown in FIG. 5, the header attachment assembly 104 may be mounted on the circuit board 106 and coupled to the connector header 102.

Advantages of the connector assembly 100 taught herein include: fabricating a comparatively small header from more expensive material while fabricating a larger assembly from less expensive material; assembling a circuit board with a reflow soldering compatible header to which can be mounted an assembly; increasing circuit board surface area; increasing circuit board density; allowing the stacking of electrical components to either side of a circuit board; allowing the addition of electrical components to either side of a circuit board after reflow soldering; allowing for entirely automated SMT assembly of circuit boards; allowing for various surface mount device soldering processes; providing improved connectively between the header and assembly; allowing for the obstructed view inserting, connecting, attaching, and coupling of components in the assembly process; providing for improved attachment through larger solder nails, and providing flexibility in manufacturing.

Additional advantages of the connector assembly 100 taught herein includes the combination of the mounting sleeve 302, the mounting shoulder 400, and the mounting shoulder rib 402. This combination of releaseably engaged elements is a solution that reduces tolerance differences for a secure attachment between the connector header 102 and header attachment assembly 104, and achieves performance criteria without fatiguing the connector header 102 or header attachment assembly 104. Alternative embodiments include various profiles and configurations of releaseably engaged mounting sleeves and mounting shoulders, such as but not limited to polygons, hexagons, octagons, circles, combinations thereof, and the like. Some alternative embodiments may not include a mounting shoulder rib 402, and some alternative embodiments include a plurality of ribs, tabs, bosses, and the like of various profiles and configurations.

Figure 6:
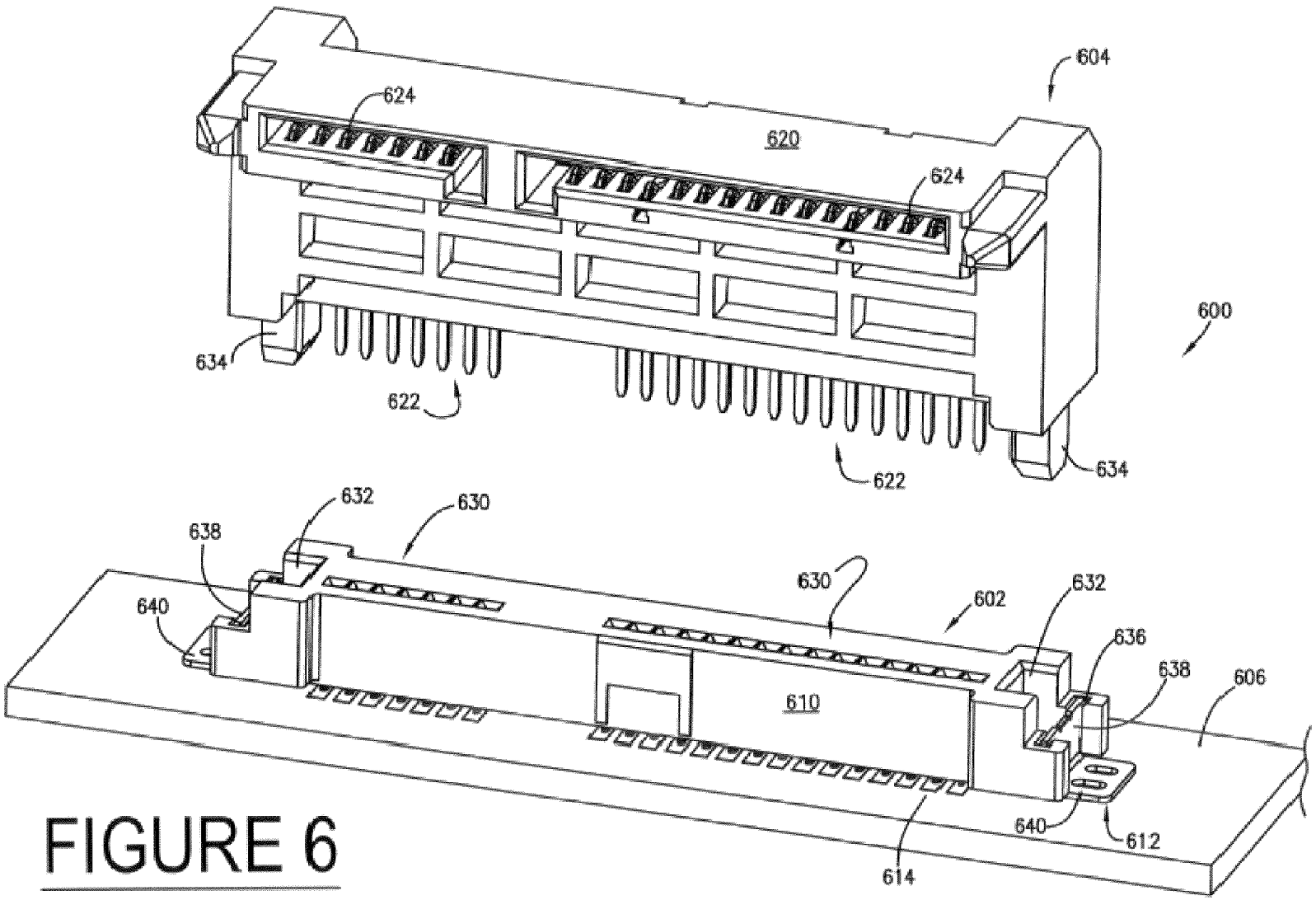
FIG. 6 is a perspective diagram showing an exemplary connector header and header attachment assembly.

FIG. 6 is a perspective diagram showing various aspects of another exemplary connector assembly 600, as disclosed herein. The connector assembly 600 as taught herein may be used with any electronic device that includes electrical components connected to a circuit board. More specifically, this embodiment is taught within the context of a serial ATA (SATA) connector communicatively connected to any type of electronic device that might store data, such as an optical drive or a hard drive. The illustrated connector assembly 600 includes a connector header 602 and a header attachment assembly 604. Here the connector header 602 will be coupled to a circuit board 606 and the header attachment assembly 604 will be coupled to the connector header 602.

The illustrated connector header body 610 is fabricated from a high-temperature thermoplastic, such as liquid crystal polymer (LCP), or polyamide nylon (PA9T), and the like, suitable for withstanding reflow solder temperature profiles. In other embodiments other high-temperature resistant materials or composites may be used to fabricate the connector header body 610. The connector header body 610 may include elements that are molded or attached, including solder nails 612 for primarily mechanically connecting and solder terminals 614 for primarily electrically connecting the connector header 602 to the circuit board 606, as described herein.

The illustrated header attachment assembly body 620 is fabricated from a less expensive thermoplastic, such as medium-density polyethylene (MDPE), or polybutylene terephthalate (PBT), combinations thereof, and the like. In other embodiments other materials or composites may be used to fabricate the header attachment assembly body 620. The header attachment assembly body 620 may include elements that are molded or attached, including connector pins 622 for connecting to the connector header 602, and conductive electronic contacts 624 for connecting to a SATA cable and thereby electronically linking the electronic device to the circuit board 606 through the connector assembly 600.

The illustrated connector header body 610 comprises a plurality of receiving channels 630, mounting sleeves 632, and engaging tab channels 636. Positioned within each receiving channel 630 is a respective connector socket (not shown) comprising a plurality of resilient spring fingers as described above. The illustrated connector header body 610 also comprises two mounting sleeves 632. Each mounting sleeve 632 is configured to receive a mounting shoulder 634 when the header attachment assembly 604 is coupled to the connector header 602. The illustrated connector header body 610 comprises two engaging tab channels 636. The engaging tab channels 636 are configured to receivingly connect an engaging tab 638 of a solder nail 612. The solder nails 612 include a securing tab 640.

In practice, the connector header 602 may be assembled by positioning and aligning each connector socket (not shown) within the connector header body 610 and with respect to a respective receiving channel 630, such that when coupling the header attachment assembly 604 to the connector header 602 a connector pin 622 may be inserted into a respective receiving channel 630 and connector socket. The engaging tab 638 may be inserted within the engaging tab channel 636 and the connector header 602 attached to a mounting surface, such as the circuit board 606.

Figure 7:
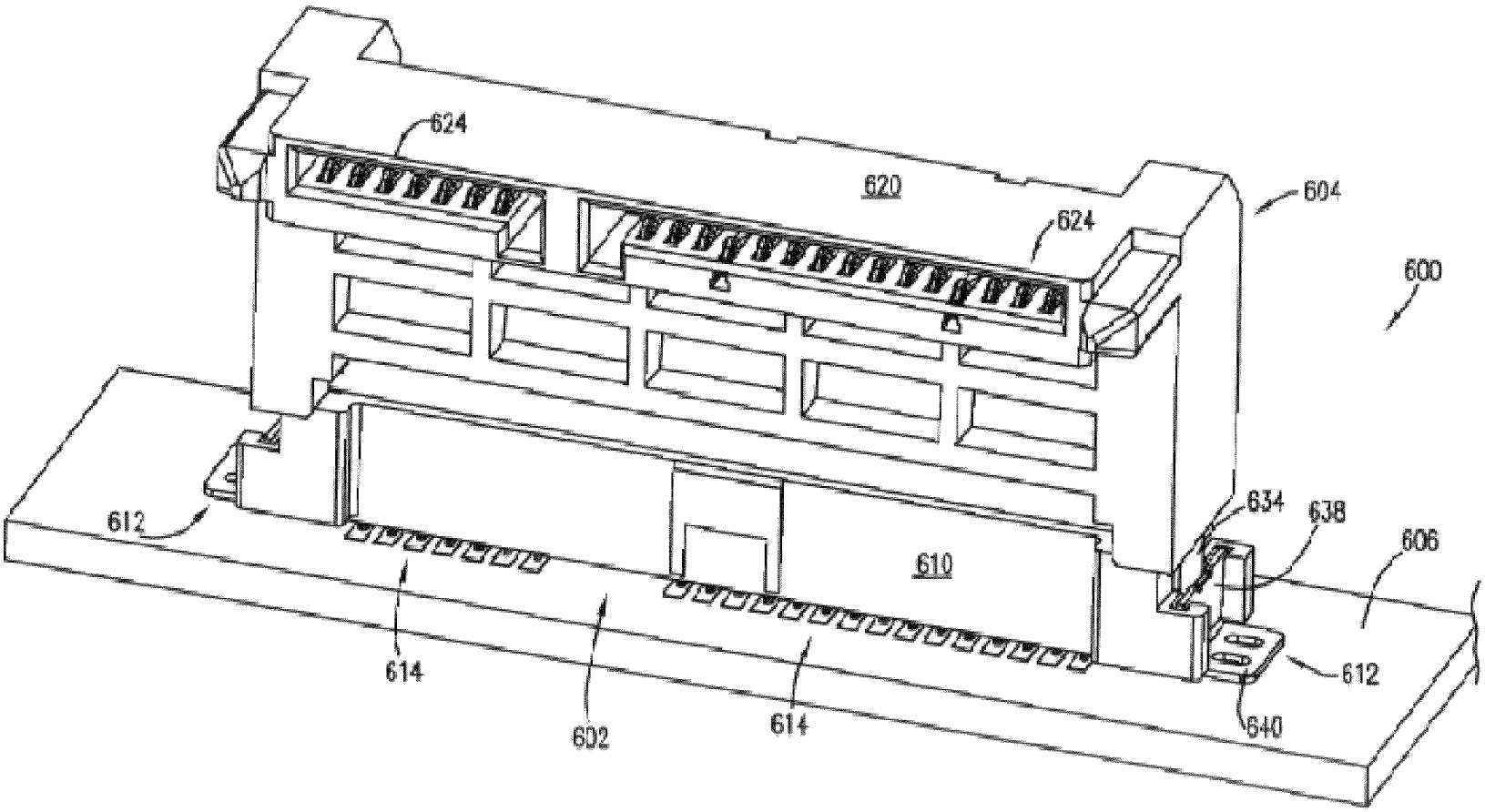
FIG. 7 is a perspective diagram illustrating an exemplary header attachment assembly mounted to a connector header.

With reference now to FIGS. 6 and 7, a method of constructing the connector assembly 600 will now be described. The connector header 602, which may include locator posts (not shown) configured to be inserted into mounting apertures (not shown), is positioned on the circuit board 606. Other electrical components may be attached to the circuit board 606 and then, together with the connector header 602, connected to the circuit board 606 during a soldering operation such as used with surface mount technology (sometimes also referred to as surface mount device) reflow soldering. During the soldering operation a solder fillet may be placed along the exterior edges of the solder terminal(s) 614 and solder nail 612 securing tab(s) 640. In this way the connector header 602 is communicatively connected to the circuit board 606.

After the soldering operation the header attachment assembly 604 may be coupled to the connector header 602 by, substantially simultaneously, aligning and inserting the mounting shoulder 634 into the mounting sleeve 632, and the connector pins 622 into the receiving channels 630 and connector sockets (not shown). In this way, as best shown in FIG. 7, the header attachment assembly 604 is coupled to the connector header 602.

Figure 8:
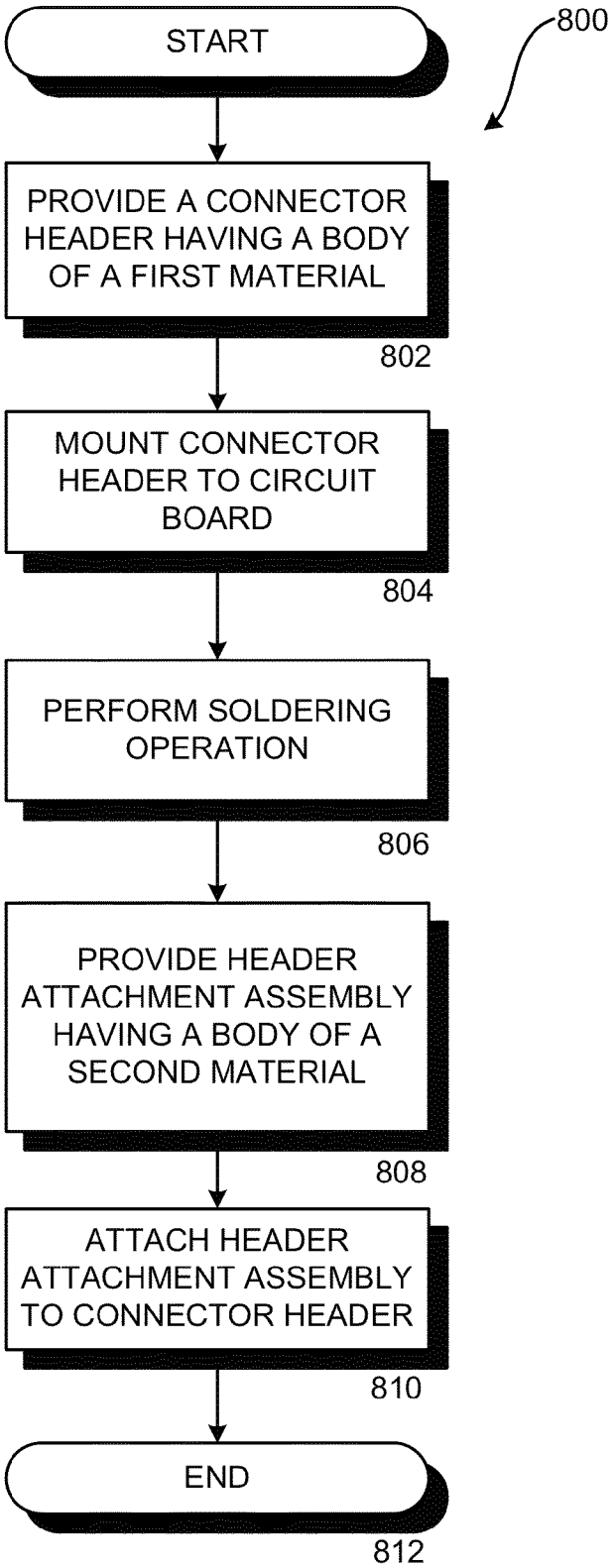
FIG. 8 is a logical flow diagram illustrating a process for manufacturing, assembling, and utilizing an exemplary connector assembly.

FIG. 8 is a logical flow diagram illustrating a process 800 for manufacturing, assembling, and utilizing the connector assembly 100, 600 disclosed herein. It should be appreciated that the operations described herein can be implemented as a sequence of manufacturing steps, mechanical operations, and physical processes. The implementation may vary depending on the performance and other requirements of a particular manufacturing system or electronic device in which the connector assembly 100, 600 disclosed herein is utilized. It should also be appreciated that more or fewer operations may be performed than shown in the Figures and described herein. These operations may also be performed in parallel, or in a different order than those described herein.

The process 800 can begin with operation 802 where an appropriate manufacturing procedure is utilized to mold the connector header body 110, 610 from a high-temperature thermoplastic suitable for withstanding surface mount technology reflow soldering temperature profiles. Elements such as connector sockets 310, solder nails 112, and the like can be attached to or molded into other elements such as the connector header body 110, 610. In this way a connector header 102, 602 is then manufactured for incorporation into an electronic device, which may include other electrical components connected to a circuit board 106, 606. From operation 802, the routine 800 proceeds to operation 804 where the connector header 102, 602 is mounted to the circuit board 106, 606, possibly with other electrical components. After the connector header 102, 602 has been mounted to the circuit board 106, 606 the routine 800 proceeds to operation 806.

At operation 806, the connector header 102, 602 is soldered to the circuit board 106, 606. The soldering operation 806 may be done manually or automatically. Automatic soldering operations include any of the surface mount technology reflow soldering processes, and the like. During the soldering operation the solder terminals 114 of the connector sockets 310 are soldered to the circuit board 106, 606. In this way the connector header 102, 602 is coupled to the circuit board 106, 606. In some embodiments solder nails 114 are also soldered to the circuit board 106, 606; in this way the solder nails 114 provide increased attachment and stability to the connector header 102, 602.

At operation 808 an appropriate manufacturing procedure is utilized to mold the header attachment assembly 104, 604 from a second material, a material which may not be suitable for high-temperature soldering operations. Elements such as connector pins 122, 622, conductive electronic contacts 124, 624, switch contacts 126, and the like can be attached to or molded into the header attachment assembly body 120, 620. A header attachment assembly 104, 604 is then provided for coupling to a connector header 102.

At operation 810 the header attachment assembly 104, 604 is coupled to connector header 102, 602. In some embodiments the header attachment assembly 104, 604 may also be attached to a mounting surface, such as a circuit board 106, 606, platform, case, and the like. The routine 800 then continues to operation 812, where it ends.

Based on the foregoing, it should be appreciated that a connector assembly 100, 600, comprising a connector header 102, 602 and header attachment assembly 104, 604, has been disclosed herein. Although the subject matter presented herein has been described in language specific to systems, methodological acts, mechanical and physical operations, and manufacturing processes, it is to be understood that the invention disclosed herein is not necessarily limited to the specific features, acts, or media described herein. Rather, the specific features, acts and mediums are disclosed as example forms.

The subject matter described herein is provided by way of illustration for the purposes of teaching, suggesting, and describing, and not limiting. Alternatives to the illustrated embodiment are contemplated, described herein, and set forth in the claims. Various modifications and changes may be made to the subject matter described herein without following the example embodiments and applications illustrated and described, and without departing from the true spirit and scope of the present invention.

What is claimed is:

1. A connector assembly for connecting an electronic device having external electrical contacts to a circuit board, comprising:

a connector header comprising a body, a plurality of connector sockets, and a plurality of solder nails, the body being manufactured from a first material which is resistant to soldering temperatures, the body having a plurality of receiving channels, a plurality of mounting sleeves, and a plurality of engaging tab channels, each receiving channel being for receiving a respective connector socket, the mounting sleeves being on a first end and a second, opposing end of the body, each engaging tab channel being open on a first end, closed on a second, opposite end, and facing another of the engaging tab channels, each connector socket comprising a receptacle having spring fingers on a first end and solder terminals on a second, opposite end, the spring fingers being oriented in a first direction and the solder terminals being oriented in a second direction which is approximately perpendicular to the first direction, the solder terminals extending from the body and configured to be soldered to the circuit board, and each solder nail being L-shaped and having a first part configured to fit between facing engaging tab channels and having a second part configured to be soldered to the circuit board to secure the connector header to the circuit board, the first part being oriented in a third direction and the second part being oriented in a fourth direction which is approximately perpendicular to the third direction; and a header attachment assembly, configured to receive the electronic device, and comprising a body and electrical conductors, the body being manufactured from a second material which may be less resistant to soldering temperatures than the first material, the body comprising a plurality of mounting posts and a plurality of mounting shoulders, each mounting post being for insertion into an aperture in the circuit board, each mounting post having either (a) a tab or (b) a boss at a distal end to limit a depth of insertion of the mounting post into the aperture of the circuit board, each mounting shoulder being configured for insertion into a respective mounting sleeve, and each of the electrical conductors having a connector pin on one end and an electrical contact on an opposing end, the connector pins being configured to reversibly mate with the spring fingers of the connector header, the electrical contacts being configured to provide a temporary electrical connection with an external electrical contact of the electronic device when the electronic device is inserted into the header attachment assembly.

2. The connector assembly of claim 1 wherein the header attachment assembly further comprises switch contacts for detecting insertion of the electronic device into the header attachment assembly.

3. The connector assembly of claim 1 wherein at least one mounting shoulder has a rib thereon.

4. The connector assembly of claim 1 wherein the connector header further comprises a plurality of locator posts for positioning the connector header on the circuit board.

5. The connector assembly of claim 1 wherein each engaging tab channel has an interior wall which faces the interior wall of the facing engaging tab channel, and an outer wall which faces the outer wall of the facing engaging tab channel, and wherein a distance between interior walls of facing engaging tab channels is greater than a distance between outer walls of the facing engaging tab channels.

6. The connector assembly of claim 1 wherein a width of the first part of the solder nail is greater than a width of the second part of the solder nail.

7. The connector assembly of claim 1 wherein:

each engaging tab channel has an interior wall which faces the interior wall of the facing engaging tab channel, and an outer wall which faces the outer wall of the facing engaging tab channel, and wherein a distance between interior walls of facing engaging tab channels is greater than a distance between outer walls of the facing engaging tab channels;

a width of at least part of the first part of the solder nail is greater than a width of the second part of the solder nail and is no greater than the distance between interior walls of facing engaging tab channels; and the width of the at least part of the first part of the solder nail is greater than the distance between outer walls of the facing engaging tab channels.

8. The connector assembly of claim 1 wherein the connector header and the header attachment assembly are used in a smart card reader, and wherein the electrical contacts of the electrical conductors of the header attachment assembly are configured to provide a temporary electrical connection with contacts on a smart card when the smart card is inserted into the smart card reader.

9. A connector assembly for connecting an electrical cable having a plurality of electrical contacts to a circuit board, comprising:

a connector header comprising a body, a plurality of connector sockets, and a plurality of solder nails, the body being manufactured from a first material which is resistant to soldering temperatures, the body having a plurality of receiving channels, a plurality of mounting sleeves, and a plurality of engaging tab channels, each receiving channel being for receiving a respective connector socket, the mounting sleeves being on a first end and a second, opposing end of the body, each engaging tab channel being open on a first end, closed on a second, opposite end, and facing another of the engaging tab channels, each connector socket comprising a receptacle having spring fingers on a first end and solder terminals on a second, opposite end, the spring fingers being oriented in a first direction and the solder terminals being oriented in a second direction which is approximately perpendicular to the first direction, the solder terminals extending from the body and configured to be soldered to the circuit board, each solder nail being L-shaped and having a first part configured to fit between facing engaging tab channels and having a second part configured to be soldered to the circuit board to secure the connector header to the circuit board, the first part being oriented in a third direction and the second part being oriented in a fourth direction which is approximately perpendicular to the third direction; and a header attachment assembly, configured to receive the electrical cable, and comprising a body and electrical conductors, the body being manufactured from a second material which may be less resistant to soldering temperatures than the first material, the body comprising a plurality of mounting shoulders, each mounting shoulder being configured for insertion into a respective mounting sleeve, and each of the electrical conductors having a connector pin on one end and an electrical contact on an opposing end, the connector pins being configured to reversibly mate with the plurality of electrical contacts of the connector header, the electrical contacts being configured to reversibly mate with the contacts of the electrical cable.

10. The connector assembly of claim 9 wherein each electrical conductor has a first part and a second part, the first part comprising the connector pin and being oriented in a first direction, and the second part comprising the electrical contact and being oriented in a second direction which is approximately perpendicular to the first direction.

11. The connector assembly of claim 9 wherein each engaging tab channel has an interior wall and an outer wall, and wherein a distance between interior walls of facing engaging tab channels is greater than a distance between outer walls of the facing engaging tab channels.

12. The connector assembly of claim 9 wherein a width of the first part of the solder nail is greater than a width of the second part of the solder nail.

13. The connector assembly of claim 9 wherein:

each engaging tab channel has an interior wall and an outer wall, and wherein a distance between interior walls of facing engaging tab channels is greater than a distance between outer walls of the facing engaging tab channels;

a width of at least part of the first part of the solder nail is greater than a width of the second part of the solder nail and is no greater than the distance between interior walls of facing engaging tab channels; and the width of the at least part of the first part of the solder nail is greater than the distance between outer walls of the facing engaging tab channels.

* * * * *